United States Patent [19]

Berkowitz

[11] 4,028,021

[45] June 7, 1977

[54] ROTARY TROCHOIDAL COMPRESSOR WITH COMPRESSIBLE SEALING

[75] Inventor: Murray Berkowitz, Woodcliff Lake, N.J.

[73] Assignee: Curtiss-Wright Corporation, Wood-Ridge, N.J.

[22] Filed: Dec. 8, 1975

[21] Appl. No.: 638,678

[52] U.S. Cl. ..... 418/56; 418/129; 418/141; 418/142; 418/153; 418/156; 418/178

[51] Int. Cl.[2] ..... F01C 1/22; F01C 19/00; F01C 5/04

[58] Field of Search ..... 418/61 A, 125, 129, 418/56, 141, 142, 178, 153, 156

[56] References Cited

UNITED STATES PATENTS

| | | | |
|---|---|---|---|
| 974,803 | 11/1910 | Lukacsevics | 418/141 |
| 2,505,197 | 4/1950 | McCulloch et al. | 418/129 |
| 2,754,050 | 7/1956 | Wellington | 418/153 |
| 2,837,031 | 6/1958 | Ilune | 418/129 |
| 3,059,584 | 10/1962 | Cottell | 418/142 |
| 3,384,055 | 5/1968 | Glenday et al. | 418/142 |
| 3,642,390 | 2/1972 | Ostberg | 418/156 |
| 3,827,835 | 8/1974 | Higuchi et al. | 418/61 A |

FOREIGN PATENTS OR APPLICATIONS

| | | | |
|---|---|---|---|
| 1,576,942 | 7/1970 | Germany | 418/153 |
| 1,944,268 | 3/1971 | Germany | 418/125 |
| 583,035 | 12/1946 | United Kingdom | 418/61 A |
| 1,350,728 | 4/1974 | United Kingdom | 418/125 |

*Primary Examiner*—John J. Vrablik
*Attorney, Agent, or Firm*—Victor D. Behn; Arthur Frederick

[57] ABSTRACT

A rotary trochoidal compressor comprising a rotor mounted for planetary motion within a housing and in which the peripheral surface of the compressor rotor is substantially a hypotrochoid and the peripheral inner surface of the housing is the outer envelope of the rotor and in which a compressible layer is provided on the inner surface of the rotor housing for sealing against the rotor peripheral surface.

3 Claims, 9 Drawing Figures

FIG. 1
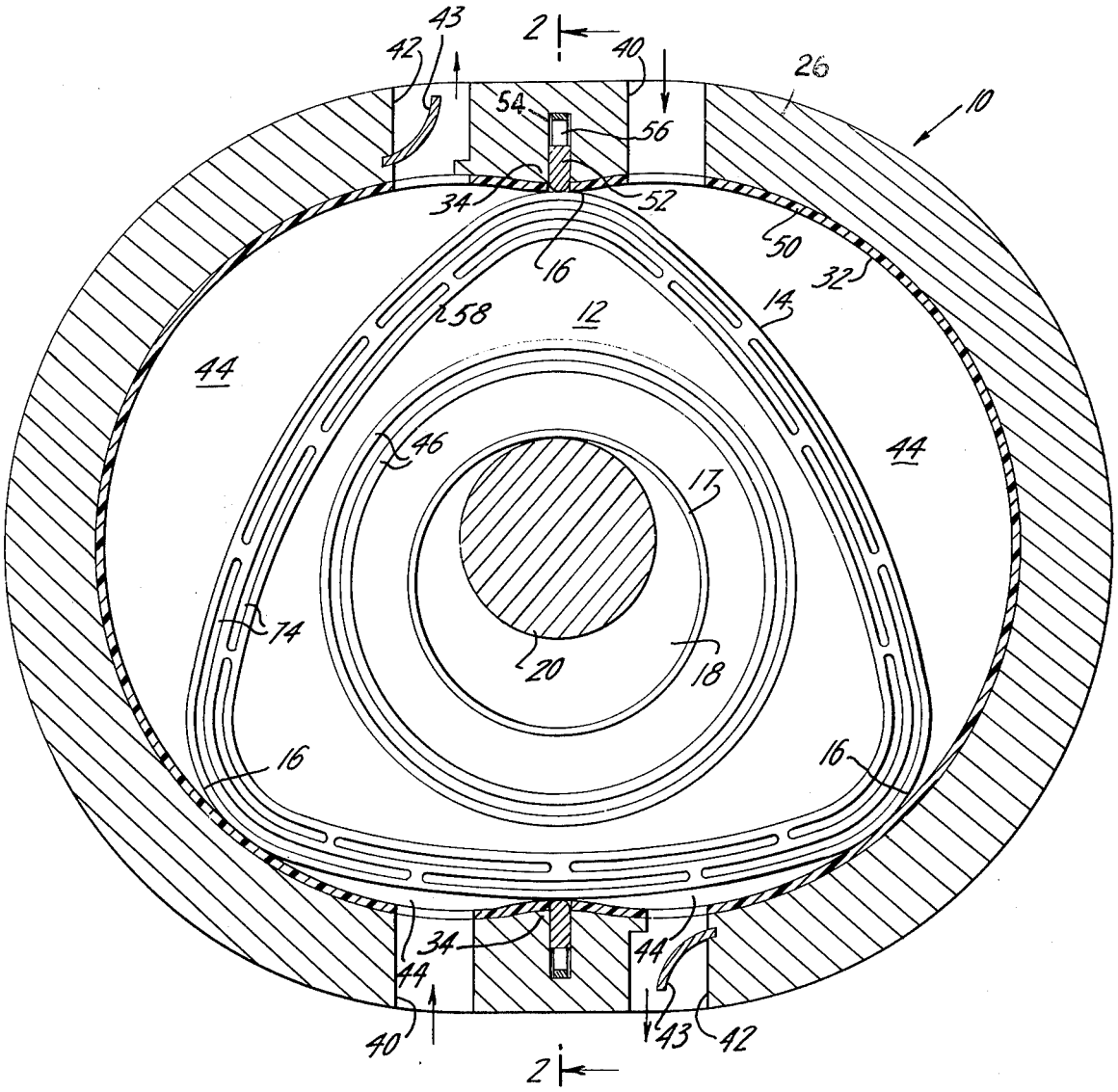
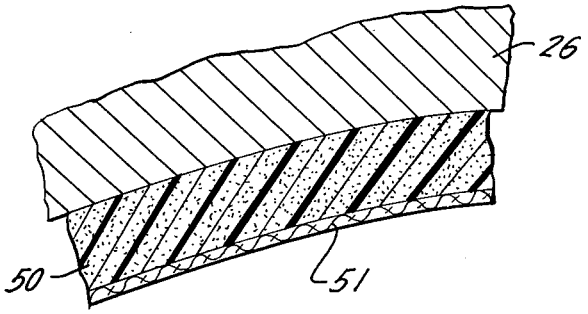
FIG. 1A

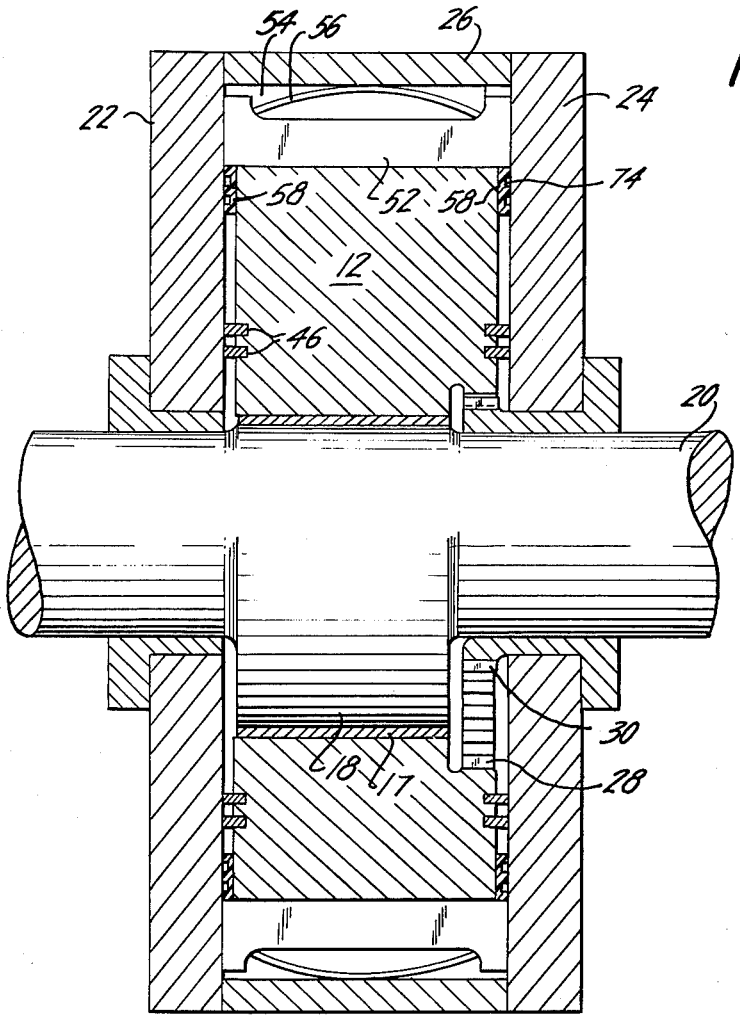
FIG. 2
FIG. 3
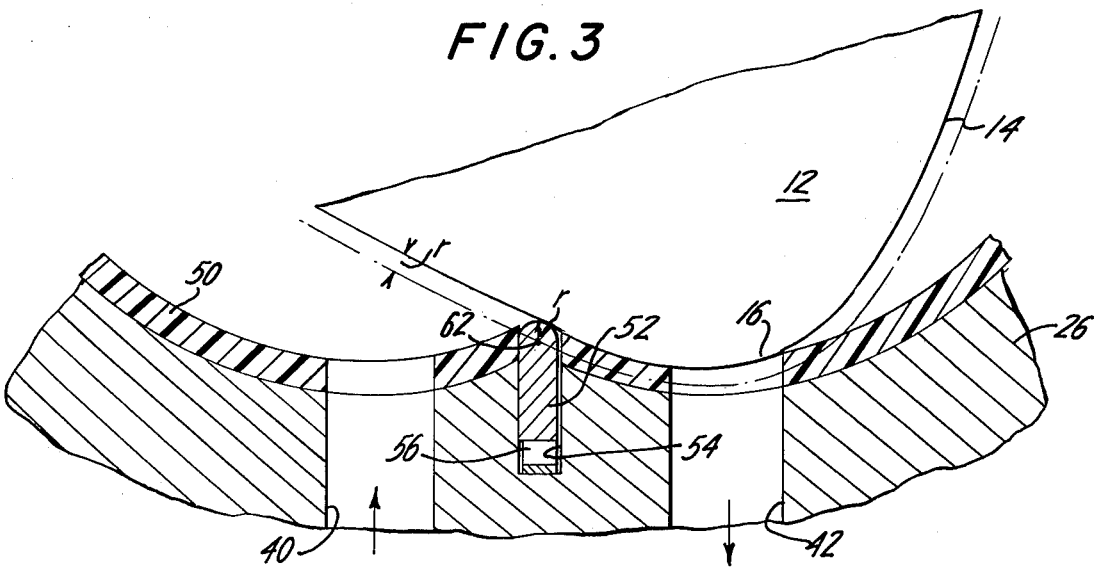

FIG. 4
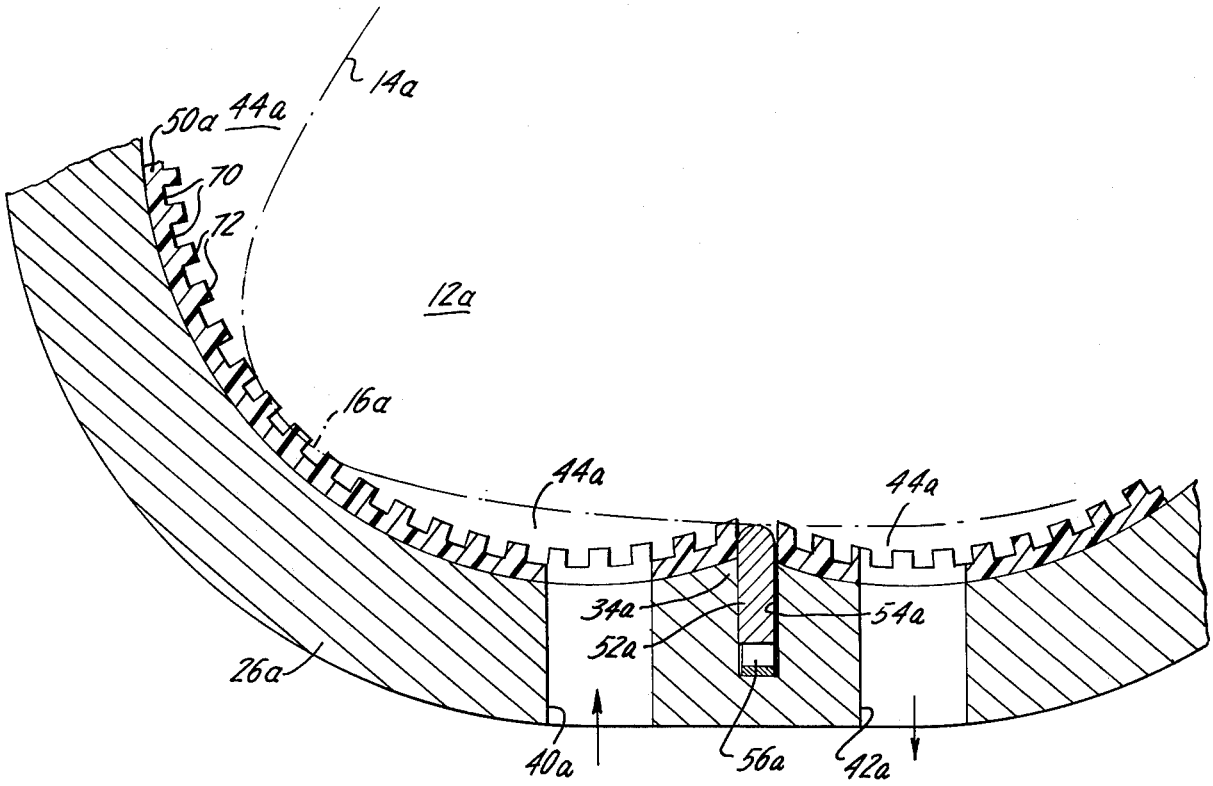
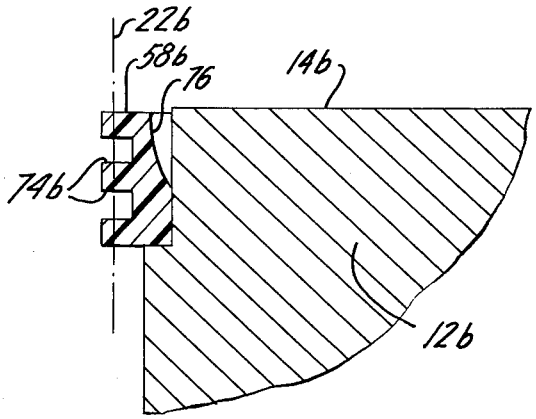
FIG. 5

FIG. 6
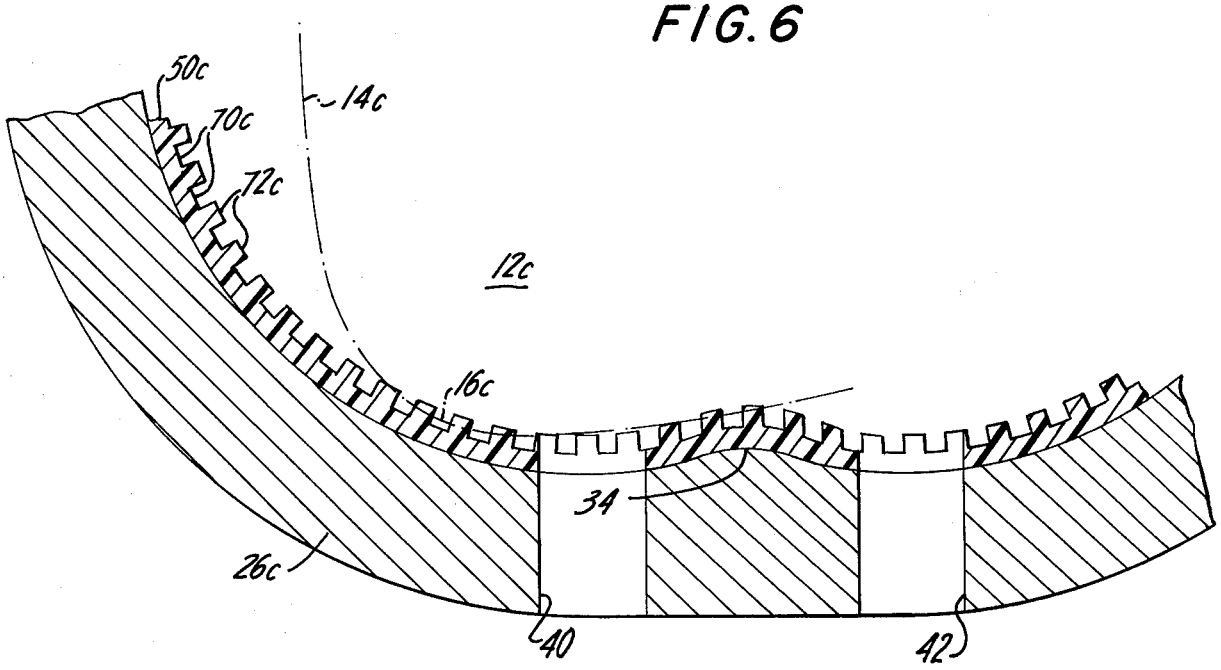
FIG. 7
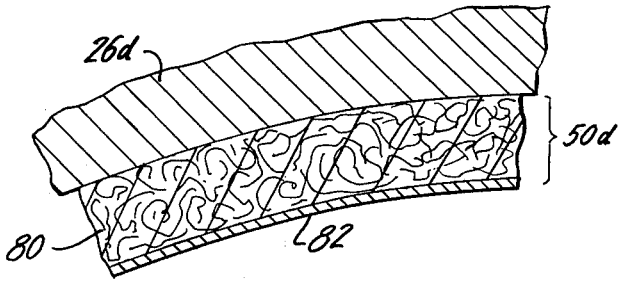
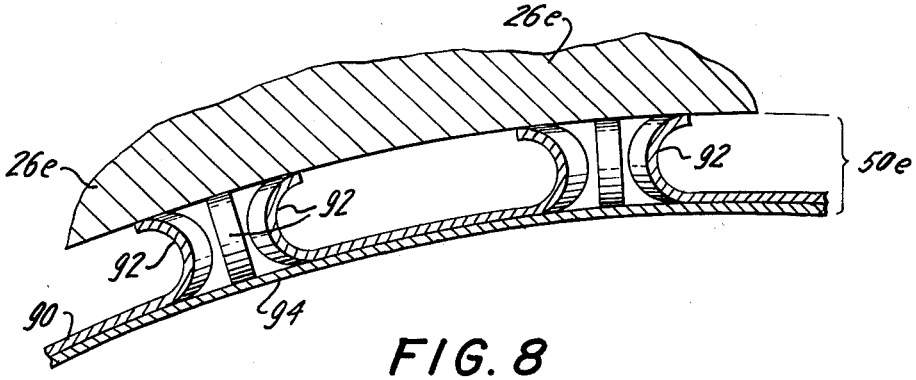
FIG. 8

ROTARY TROCHOIDAL COMPRESSOR WITH COMPRESSIBLE SEALING

BACKGROUND OF INVENTION

The invention relates to rotary mechanisms, particularly to rotary compressors or expansion engines in which the rotor has a planetary motion within a housing and the peripheral surface of the housing is substantially a hypotrochoid and the inner surface of the housing is substantially the outer envelope of the relative rotary motion of the rotor. Such a compressor or expansion engine is disclosed in U.S. Pat. No. 3,387,772 granted June 11, 1968 to Wutz and in British Pat. No. 583,035 granted on Dec. 5, 1946 to Maillard, and is generally known as a Maillard-type compressor. The invention will herein be described in terms of compressor operation although as will be apparent, it is also applicable to expansion engines.

Various trochoidal-type compressors have been proposed in the past in which either the outer periphery of the rotor or the inner periphery of the rotor housing is a trochoidal surface, either an epitrochoid or a hypotrochoid. For example, U.S. Pat. No. 3,671,153 granted on June 20, 1972 to Luck shows a compressor in which the inner surface of the rotor housing is an epitrochoid. A rotary mechanism having the geometry of the rotor and rotor housing shown in the Luck patent is generally known as a Wankel-type rotary mechanism. It has been determined that a Maillard-type compressor has the advantage in that the minimum volume of each working chamber is reduced substantially to zero at the end of the discharge stroke of each working chamber thereby providing a compressor with high volumetric efficiency.

The efficiency of a rotary compressor depends on the provision of adequate sealing for each working chamber. In a Maillard-type compressor it is essential to provide sealing between each rotor nose portion and the inner periphery of the rotor housing as well as between the point or points on the rotor housing periphery which generate or trace the hypotrochoid surface of the rotor as the rotor rotates relative to the housing. However, in the case of a Maillard-type compressor, each rotor nose or apex portion, instead of being pointed as in a Wankel-type configuration, is rounded and the seal contact line with the rotor housing shifts about this rounded nose portion as the rotor rotates relative to the rotor housing. Therefore, in the case of a Maillard-type compressor a radially movable seal bar carried in a slot extending axially across the nose portion of the rotor would have to shift radially relative to the rotor to maintain seal contact with the rotor housing. Any such required radial motion of the rotor apex or nose seals necessarily reduces the effectiveness of the seal since, because of friction forces and the short response time, the seal may not maintain seal contact with the rotor housing. Also, such required seal motion would increase the amount of lubrication required to minimize seal wear.

SUMMARY OF INVENTION

It is an object of the invention to provide a Maillard-type rotary compressor with novel and effective sealing arrangement for the compressor working chambers.

In accordance with the invention, the compressor is provided with a novel seal configuration in which at least the major portion of the inner surface of the rotor housing is provided with a compressible liner against and over which the rotor nose portions slide during compressor operation. This liner should have good elastic properties, and should have an external surface which, with respect to relative sliding of the rotor nose portions, has low friction and low wear. An effective and simple positive seal is thereby provided between each rotor nose portion and the rotor housing. This type of seal is particularly suitable for a Maillard-type compressor because in such a configuration the nose or apex portions of the rotor have a curved profile of large radius as compared to the pointed apex portions in a Wankel-type configuration.

It, therefore, is a further object of the invention to provide rotary compressors in which a positive seal is provided between the rotor nose portions and the rotor housing by having the nose portions slightly depress a liner of compressible material or construction on the rotor housing. In one form of the invention, the compressible liner may be provided with recesses, for example, in the form of axial grooves in order to provide the liner with the desired degree of flexibility to accommodate relative rotation of the rotor while permitting use of liner material having adequate low friction and wear properties. The liner could also be made of metallic material with a construction to provide it with the desired compressibility. It is recognized that the compressors or expansion engines have been provided with compressible or elastomeric liners or seals, for example, as shown in U.S. Pat. No. 3,827,835 granted on Aug. 6, 1974 to Higuchi and in U.S. Pat. No. 3,081,022 granted on Mar. 12, 1963 to Michie. The Higuchi Patent, however, is directed to compressors or expansion engines having a Wankel-type configuration with its relatively pointed rotor apex portions which thereby makes it difficult to provide a simple seal between the rotor nose portions and compressible liner on the rotor housing. In contrast, in the present invention the rotor instead of having pointed apex portions has rounded nose portions which greatly facilitates a seal running against a compressible liner. The Michie Patent discloses a compressible liner for a compressor rotor. However, in the Michie Patent the compressor is of a totally different type. Attention is also directed to U.S. Pat. No. 3,086,476 granted Apr. 23, 1963 to Weiss. This patent discloses a rotary pump in which the pump housing is provided with fibrous yieldable sealing layer between its intake and output sides. This fibrous layer of the Weiss Patent is intended to wear in and therefore in normal pump operation would not constitute a seal which yields to accommodate relative rotation of the pump parts. Also, the Weiss Patent does not disclose a compressor which, as in a Maillard-type compressor, has internal working chambers which vary in volume to compress the fluid and therefore requires a seal grid around each such working chamber.

It is a still further object of the invention to provide a mechanical seal strip or bar at each waist portion of the rotor housing in combination with a compressible liner for the rotor housing, each said waist portion constituting a point or axial line which generates the hypotrochoid periphery of the rotor as the rotor rotates relative to the rotor housing.

Another object of the invention resides in the provision of a compressible seal between the sides of the rotor and the adjacent end walls of the compressor housing in combination with a compressible liner for the rotor housing thereby providing a positive seal grid around each working chamber of the compressor.

Other objects of the invention will become apparent upon reading the following detailed description in connection with the drawings.

BRIEF DESCRIPTION OF THE DRAWINGS

FIG. 1 is a transverse sectional view of a rotary compressor embodying the invention;

FIG. 1A is an enlarged view of a portion of FIG. 1 showing one form of the rotor housing liner;

FIG. 2 is an axial sectional view taken along line 2—2 of FIG. 1;

FIG. 3 is an enlarged view of a sealing bar and adjacent rotor and housing portions of FIG. 1;

FIG. 4 is an enlarged view of a portion of FIG. 1 illustrating another form of the rotor housing liner;

FIG. 5 is an enlarged view of a portion of FIG. 2 illustrating a modified form of the compressible seal between the rotor and the housing end walls;

FIG. 6 is a view similar to FIG. 4 but illustrating a modified form of the invention; and FIGS. 7 and 8 are enlarged views similar to FIG. 1A but showing two further forms of a compressible liner for the housing.

DESCRIPTION OF PREFERRED EMBODIMENTS

Referring first to FIGS. 1 and 2 of the drawing which disclose a rotary compressor 10 in which the inner body or rotor 12 of the compressor has a peripheral surface 14 which is a hypotrochoid having three apex or nose portions 16. The rotor 12 is rotatably journaled by a bearing 17 on the eccentric portion 18 of a shaft 20 which is coaxially supported in an outer body or housing consisting of a pair of axially-spaced end walls 22 and 24 and an intermediate peripheral wall or rotor housing 26. The housing walls 22, 24 and 26 are suitably secured together as by bolts (not shown).

The rotor 12 has an internal gear 28 secured to one end face of the rotor and disposed in mesh with a gear 30 secured to the adjacent housing end wall 24. The gears 28 and 30, in effect, form the rolling circles for generating the hypotrochoid surface 14. For generating a hypotrochoid having three apex portions as illustrated, the gears 28 and 30 are provided with a diameter ratio of 3:2.

The inner peripheral surface 32 of the intermediate or rotor housing 26 is approximately the outer envelope of the rotor trochoidal peripheral surface 14. That is, the surface 32 is approximately the outer envelope of the various positions of the rotor peripheral surface 14 relative to the rotor housing 26. The resulting peripheral surface 32 has two waist portions 34 which, in effect, generate the hypotrochoidal surface 14 as the rotor rotates relative to rotor housing 26. Therefore, each of the two waist portions 34, in effect, is a generating line (herein termed generating element) which extends axially across the rotor housing 26 and generates the hypotrochoid rotor surface 14 as the rotor 12 rotates relative to its rotor housing 26.

The rotary mechanism 10 is also provided with an intake port 40 and an outlet or exhaust port 42 disposed on opposite sides of each hypotrochoid generating element 34. Each exhaust port 42 preferably is provided with a check valve schematically shown at 43 to prevent reverse flow into the compressor.

With the structure described, a plurality of working chambers 44 are formed between the rotor 12 and rotor housing 26. Each of these chambers extend circumferentially from a rotor nose portion 16 to another nose portion or to a hypotrochoid generating element 34. If the shaft 20 rotates in a clockwise direction, as viewed in FIG. 1, the rotor 12 also rotates clockwise but at one-third the speed of the shaft. As the rotor 12 rotates, fluid is drawn in through the lower left-hand intake port 40 into a working chamber 44 and fluid is being pumped out through the upper left-hand exhaust port 42 from another working chamber 44, and at the same time fluid is similarly being drawn in through the upper right-hand intake port 40 and is being pumped out through the lower right-hand exhaust port 42. Thus, each half of the rotary mechanism 10 on opposite sides of a vertical plane through the generating elements 34 functions as a compressor. In order to prevent oil escaping from the rotor bearing 17 from leaking radially outwardly between the rotor and housing end walls 22 and 24, the rotor end faces are provided with one or more annular oil seals 46 received in grooves in the rotor end faces and urged axially by springs (not shown) against the adjacent housing end walls 22 and 24. The structure so far described is conventional.

For efficient compressor operation, adequate sealing must be provided between each generating element 34 and the trochoidal surface 14 of the rotor 12 and between each rotor nose 16 and the inner peripheral surface 32 of the rotor as well as between the sides of the rotor 12 and the adjacent end walls 22 and 24.

In accordance with the invention, the main or base portion of the rotor housing 26 is of rigid material (such as a metal) and the inner surface of this housing is provided with a liner 50 of elastically compressible material or construction attached thereto as by bonding. The inner surface of the liner 50 is disposed slightly radially inwardly of the outer envelope of the various positions of the rotor peripheral surface 14 relative to the rotor housing 26. As a result, if the liner 50 were of rigid material such as solid metal, it would mechanically interfere with the peripheral surface 14 of the rotor to prevent rotation of the rotor within the rotor housing 26 and even assembly of the rotor within said housing. Instead, the liner 50 being elastically compressible, it yields or is depressed by the rotor peripheral surface 14. Thus, each rotor nose portion 16 protrudes slightly into the liner 50 to provide a seal therebetween in all positions of the rotor 12.

The material of the liner 50 may be soft or elastically resilient like an elastomeric material or it can mechanically configured so as to be elastically compressible. The liner 50 must, however, be sufficiently thick to permit each nose portion 16 of the rotor 12 to press into the liner so that the contact pressure therebetween is sufficient to seal against the maximum pressure differential that will occur between adjacent working chambers 44. The thickness of the liner 50 must also be such than the outer surface of the liner is somewhat larger than the outer envelope of the rotor so as to avoid any mechanical interference between the rotor 12 and the rigid rotor housing 26.

The liner 50 also must have a sufficiently slippery or low friction surface and be sufficiently durable to avoid undue friction and wear between it and the rotor as the rotor rotates relative to the rotor housing. A material generally suitable for this purpose is a bronze-filled teflon. Such a teflon material having a 60% filling of bronze particles is available commercially from E. I.

Dupont De Nemours & Co. under the tradename "Teflon 1146".

A sponge-type teflon, silicone sponge rubber or other plastic sponge material having compressible or elastomeric-like properties and having a skin over its inner surface for sliding contact with the rotor nose portions could also be suitable. This skin could be formed in the fabrication of the sponge material or as illustrated in FIG. 1A it could consist of a sheet 51 bonded to the surface of the base sponge material of the compressible liner 50. The sheet 51 could be of sheet metal material or it could comprise a plastic sheet. For example, this skin could comprise a plastic sheet consisting of teflon fibers layered or interwoven with fibers of other low friction material. Examples of such woven plastic material are commercially available under the tradenames "Fibriloid" and "Fiberglide" from the Transport Dynamics Division of Lear Siegler, Inc. The particular material chosen for the compressible liner 50, particularly its skin surface, obviously must be inert to the gas being pumped by the compressor 10.

At each of the two waist portions 34 of the rotor housing 26, there is provided a radially movable seal bar 52 extending axially across said housing in a groove 54. A spring 56 is disposed under each seal bar 52 between the seal bar and the bottom of its groove 54 for urging the seal bar into continuous contact with the rotor peripheral surface 14.

The seal bars 52 thereby seal one end of each working chamber 44 at each waist portion 34 of the rotor housing peripheral surface 32. The other end of each working chamber 44 is sealed by the sliding contact of each rotor nose portion 16 with the compressible liner 50. The axial sides of each working chamber are sealed by a compressible seal strip 58 attached, as by bonding, to each end face of the rotor 12 and being squeezed between said rotor end face and the adjacent end wall 22 or 24 to provide a seal therebetween. Each compressible seal strip 58 is disposed immediately adjacent to the peripheral surface 14 of the rotor and extends circumferentially completely about the axis of the rotor 12. The compressible seal strips 58 thereby complete the seal grid about each working chamber 44. The compressible seal strips 58 can be made of essentially the same material as the compressible liner 50.

Each housing seal bar 52 preferably is provided with a rounded tip to minimize wear as this seal tip slides over the rotor surface 14. As a result of rotation of the rotor 12 relative to the rotor housing 26, the seal bar 52 is not always perpendicular to the rotor surface 14 and, in general, makes an angle to this surface which varies as the rotor rotates. Because of this angular variation of the seal bar 52 relative to the rotor surface and because the tip of the seal bar is rounded, the seal bar must shift radially in its slot 54 to maintain contact with the rotor surface if this surface is a true hypotrochoid. This radial motion of the seal bar is objectionable because it involves frictional sliding of the seal bar along a side of its groove 54. Theoretically, this radial motion could be eliminated by providing the seal bar with a pointed tip. This is impractical however, since such a pointed tip would quickly wear to a blunt tip.

To avoid this problem and, as best seen in FIG. 3, the tip of each seal bar 52 is rounded with a radius *r* and the surface 14 of the rotor 12 instead of being made a true hypotrochoid is made parallel to a theoretical or true hypotrochoid 60 generated by each point 62 which is the center of curvature of the rounded tip of its seal bar 52, the surface 14 being displaced radially inwardly of the theoretical hypotrochoid 60 by said distance *r*. This seal tip construction is similar to that shown in British Pat. No. 1,154,090 granted June 4, 1966 to Huf, but for a rotor having an epitrochoidal peripheral surface rather than a hypotrochoid. With this construction, the point 62 will generate a true or theoretical hypotrochoid 60 as the rotor rotates. At the same time, since the rotor surface 14 is parallel to this true hypotrochoid by a distance *r* which is the same as the tip radius of the seal bar 52, no radial motion of the seal bar 52 is required to maintain sealing contact with the rotor surface 14. Some radial motion of the seal bar 52 will, of course, take place in actual practice because of such factors as manufacturing tolerances and bearing clearances. Also, since the distance *r* is small and since the rotor peripheral surface 14 is parallel to a true hypotrochoid, the surface 14 is substantially a hypotrochoid. As in FIG. 1, the rotor housing surface 32 is substantially the outer envelope of the various positions of the rotor peripheral surface 14 relative to the rotor housing 26.

FIG. 3 also illustrates the rotor 12 in a position in which a nose portion 16 of the rotor is moving past a discharge port 42. That is, the rotor is in a position in which it has just completed discharge of a working chamber 44 through the exhaust port 42. As illustrated in FIG. 3, with the rotor 12 in this position, the seal between the rotor nose portion 16 and the adjacent portion of the rotor housing has almost reached the stationary housing seal 52 so that the circumferential distance between these seal points is approaching a small value. This fact, coupled with the close fit between the rotor periphery 14 and the housing surface 32, results in the volume of this working chamber 44, which has just completed its discharge, being substantially zero. As a result, the compressor 10 of the present invention has a high volumetric efficiency.

The fact that the circumferential dimension as well as the radial dimension of each working chamber 44 decreases during the compression stroke is a distinct advantage over conventional piston-type compressors or in compressors of the type shown in U.S. Pat. No. 3,226,013 (FIGS. 21 or 23) granted Dec. 28, 1965 to Toyoda et al or in U.S. Pat. No. 724,665 granted Apr. 7, 1903 to Cooley and generally known as a Cooley-type compressor. In such prior art compressors only the radial dimension of the compressor working chambers decreases during the compression stroke and as a result their minimum volume cannot be reduced to the same extent as in compressors of this invention. In this latter connection it is noted that in a Cooley-type compressor the rotor has an epitrochoidal surface which, in the minimum volume position of a working chamber, theoretically can be made to fit very close to the adjacent portion of the rotor housing. However, in order to facilitate fluid flow from each working chamber into the outlet port, and to avoid mechanical interference between the rotor and rotor housing, a significant minimum volume must be provided between the rotor and rotor housing of a Cooley-type compressor.

In the above discussion of volumetric efficiency of the compressor 10 of the present invention, it is assumed that the check valve 43 in each compressor outlet port is disposed close to the inner peripheral surface 32 of the rotor housing so that the volume of the space between the check valve and said inner peripheral surface of the rotor housing is small.

In a particular application it may be difficult to find material for the liner 50 having sufficient durability and wear resistance at the temperatures and pressures encountered in compressor operation and still be sufficiently compressible. FIG. 4 illustrates a modification of the construction of the liner to provide it with the desired compressibility. For ease of understanding, the parts of FIG. 4 have been designated by the same reference numerals as the corresponding parts of FIG. 1, but with a subscript *a* added thereto. Also, in FIG. 4 the rotor peripheral surface 14*a* is shown in dot-and-dash outline so as to illustrate its depression into the compressible liner 50*a*.

In FIG. 4, the compressible liner 50*a* is provided with a plurality of grooves 70 extending axially across the rotor to form flexible ribs 72 which can more readily be deformed by the rotor 12 as the rotor rotates relative thereto. In this way, the compressibility or flexibility of the liner 50*a* to deflection by the rotor 12 can readily be varied within limits by varying the depth and/or spacing of the grooves 70.

As illustrated in FIGS. 1 and 2, each compressible seal strip 58 is also provided with grooves 74 for increasing the compressibility of this strip so that it more readily yields to compression between the rotor sides and the housing end walls 22 or 24.

The grooves 70 in the compressible liner 50*a* extend axially across the rotor housing so that leakage cannot occur along these grooves between working chambers 44. In the case of the compressible seal strips 58, the grooves 74 extend in a circumferential direction generally parallel to the rotor periphery so that leakage cannot take place along these grooves between the rotor and the housing end walls. In lieu of elongated grooves 70 or 74, the liner 50*a* and/or the seal strips 58 could be provided with hole-like depressions to provide the desired flexibility.

FIG. 5 illustrates a modification of FIG. 1 so as to increase the axial pressure of the side seal strips 58 against the adjacent housing end walls 22 or 24. The parts of FIG. 5 have been designated by the same reference numerals as the corresponding parts of FIG. 1 but with a subscript *b* added thereto.

In FIG. 5 each side seal strip 58*b* is provided with a plurality of circumferentially-spaced notches 76 extending radially inwardly from the outer edge of said seal strip and being formed on the surface of said strip abutting the adjacent end surface of the rotor 12*b*. With this arrangement, pressure from the adjacent working chambers can enter the notches 76 to help press the seal strip 58*b* against the adjacent housing end wall 22 or 24. In FIG. 5, the adjacent housing end wall 22*b* has been shown in dot and dash outline so as to illustrate the extent to which the seal strip is compressed between the rotor and said end wall.

Reference is now made to FIG. 6 which illustrates a further modification in which the housing seal bars 52 or 52*a* have been eliminated. The parts of FIG. 6 have been designated by the same reference numerals as the corresponding parts of FIGS. 1 and 4 but with a subscript *c* added thereto. Again, as in FIG. 4, the periphery of the rotor has been shown by a dot-and-dash line to more clearly show the yield of the compressible liner 50*c* to the rotor.

In FIG. 6, the housing seal bars 52 or 52*a* have been eliminated and instead the liner 50*c* extends over each waist portion 34*c* of the inner surface of the rotor housing 26*c*. The compressible liner 50*c* now provides the seal between the rotor surface 14*c* and each waist portion 34*c* of the rotor housing. The construction of FIG. 6 has the disadvantage, compared with FIGS. 1 or 4, in that the portion of the compressible liner 50*c* at the rotor housing waist portions 34*c* is subject to continuous wear contact with the rotor whereas the balance of this liner is only intermittently subject to wear from the rotor nose portions. The construction of FIG. 6, however, has the advantage of being a simpler construction and, therefore, for certain applications may be preferred to that of FIGS. 1 and 4. In lieu of the grooved liner 50*c* shown in FIG. 6, a liner having a smooth, continuous external surface as in FIG. 1 could be substituted.

Referring back to FIG. 1, the compressible liner 50 instead of being made of plastic or elastomeric material as there described, this liner could also be formed from metallic material. For example, the compressible liner could consist of a fibrous metallic mesh with a thin sheet of flexible metallic material bonded to its inner surface. Such a modification is illustrated in FIG. 7. For ease of understanding, the parts of FIG. 7 have been designated by the same reference numerals as the corresponding parts of FIG. 1 but with a subscript *d* added thereto.

In FIG. 7, the rotor housing 26*d* is provided with a compressible liner 50*d* consisting of fibrous metallic material 80 bonded to the inner surface of the rotor housing 26*a* and over which a thin layer or sheet 82 of flexible metallic material is bonded. This thin flexible sheet 82 obviously should have an inner surface which is both wear resistant and has low sliding friction to movement of the rotor nose portions thereover and for this purpose a suitable coating may be plated or otherwise applied over the inner surface of the flexible sheet 82. As in the case of the liner 50 of FIG. 1, the metallic flexible liner 50*d* has a radial dimension which is sufficient to provide a slight interference fit with and therefore be compressible by the nose portions 26 (not shown in FIG. 7) of the rotor to form a seal therebetween in essentially the same manner as the plastic liner 50 of FIG. 1. Obviously, the metallic liner 50*d* could also be used in an embodiment in which the housing seal bars 50 or 52*a* have been eliminated as in FIG. 6.

FIG. 8 shows another modified form of a compressible metallic liner for the rotor housing. Again, the parts of FIG. 8 have been designated by the same reference numerals as the corresponding parts of FIG. 1 but with a subscript *e* added thereto.

In FIG. 8 the rotor housing 26*e* is provided with a compressible metallic liner 50*e* consisting of a thin sheet 90 of flexible metallic material out of which a plurality of resilient finger-like projections 92 are struck. The fingers 92 are spaced over the entire surface of the metallic sheet 90 and flare outwardly from the sheet for contact with and bonding to the rotor housing 26*e* so as to support the sheet 90 in spaced relation to the rotor housing. The fingers are curved as illustrated so that they can bend elastically so as to permit the metallic sheet 90 to be locally elastically deformed a limited distance toward and away from the rotor housing. A layer or second thin sheet 94 of flexible metallic material is disposed over the sheet 90 to form a smooth inner surface for sliding contact with the nose portions (not shown in FIG. 8) of the rotor. Thus, the flexible liner 50*e* cooperates with and is compressible by the nose portions 16 (not shown in FIG. 8) of the rotor to form a seal therebetween in essentially the same manner as in FIG. 1.

It is obvious that the plastic or elastomeric liner 58 of FIG. 1 could also be replaced by a flexible metallic construction, for example, of the type shown in FIGS. 7 and 8. It is also obvious the other types of mechanical constructions could be employed to provide a flexible mechanical liner 50 or 58. In lieu of the sheet metal liners 82 and 94 of FIGS. 7 and 8 respectively, a plastic sheet material such as described in connection with FIG. 1A could be used.

As already noted, although the invention has been described in terms of compressor operation, the invention is equally applicable to expansion engines. Also, the invention is not limited to the specific geometric configuration illustrated. For example, the hypotrochoid surface of the rotor could be provided with a different number of apex portions by changing the diameters of the rolling circles from which the hypotrochoid is generated. Thus, instead of three apex portions, as illustrated, the rotor could have only two such apex portions or it could have more than three such portions with the inner surface of the rotor housing being the outer envelope of the various positions of the rotor as the rotor rotates. In addition, instead of the compressor intake and exhaust ports being in the rotor housing, as illustrated, they could be placed in one or both of the housing end walls.

While the invention has been described in detail in its present preferred embodiments, it is obvious to those skilled in the art, after understanding the invention, that various changes and modifications may be made therein without departing from the spirit and scope thereof. The appended claims are intended to cover such modifications.

What is claimed is:

1. A rotary mechanism such as a compressor, expansion engine or the like comprising:

a. an outer body comprising a pair of axially-spaced end walls and an intermediate wall defining a cavity therebetween;

b. an inner body mounted for relative rotation within said cavity and having its axis eccentric to the axis of the outer body, the peripheral surface of said inner body being substantially a hypotrochoid with three nose portions rigid therewith and the inner peripheral surface of said intermediate wall being approximately the outer envelope of the peripheral surface of the inner body such that said intermediate wall peripheral surface has two diametrically opposed regions which generate said hypotrochoidal surface during relative rotation of said bodies and such that a plurality of fluid working chambers are formed between said inner body and said intermediate wall peripheral surface;

c. radially movable seal bar means carried by the outer body intermediate wall at each of said hypotrochoid generating regions and spring means for urging each seal bar means into continuous sealing contact with the hypotrochoid peripheral surface of the inner body;

d. said outer body having intake and outlet ports disposed on opposite sides of each said generating region; and e. a compressible liner for the peripheral surface of said intermediate wall, said liner extending over the entire portion of said peripheral surface except said liner being interrupted at each said seal bar means and the inner surface of said liner being disposed slightly radially inwardly of the outer envelope of the inner body so that except when under one of said seal bars the rigid nose portions of the inner body continuously depress the liner slightly as the inner body rotates to provide a continuous seal between said nose portions and the liner in all positions of the inner body, said liner comprising a radially flexible base portion and having a flexible sheet-like layer over the inner surface of said base portion for sliding contact with the rigid nose portions of the inner body.

2. A rotary mechanism as claimed in claim 1 in which said compressible liner has a base portion of elastomeric material and has a flexible sheet-like layer over its inner surface for sliding contact with the nose portions of the inner body.

3. A rotary mechanism as claimed in claim 1 in which the base portion of said compressible liner has a metallic construction which is elastically flexible in a radial direction relative to the engine axis and said liner has a layer of flexible sheet material for sliding contact with the nose portions of the inner body.

* * * * *